US007011190B2

(12) United States Patent
Moriarity et al.

(10) Patent No.: US 7,011,190 B2
(45) Date of Patent: Mar. 14, 2006

(54) HAND BRAKE ASSEMBLY FOR AN ANKLE MOTION III TRUCK BOGIE

(75) Inventors: Michael J. Moriarity, Ansing, IL (US); Howard Sommerfeld, Oak Forest, IL (US); David C. Brabb, Chicago, IL (US); Anand Prabhakaran, Clarendon Hills, IL (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/857,079

(22) Filed: May 28, 2004

(65) Prior Publication Data

US 2005/0034933 A1 Feb. 17, 2005

Related U.S. Application Data

(60) Provisional application No. 60/432,772, filed on May 28, 2003.

(51) Int. Cl.
*B61H 13/00* (2006.01)

(52) U.S. Cl. ..... 188/33; 188/107; 74/505

(58) Field of Classification Search ..... 188/33, 188/34, 46, 209, 49–54, 153 R, 219.1–233.7, 188/107, 265, 234, 236, 1.11 R, 1.11 W, 188/1.11 L, 215; 74/505; 192/12 R, 15, 192/82 R, 13 R See application file for complete search history.

(56) References Cited

U.S. PATENT DOCUMENTS

| | | | | |
|---|---|---|---|---|
| 4,368,648 | A * | 1/1983 | Housman et al. | 74/505 |
| 6,279,696 | B1 * | 8/2001 | Daugherty et al. | 188/215 |
| 6,305,504 | B1 * | 10/2001 | Ring | 188/52 |
| 2005/0034933 | A1 * | 2/2005 | Moriarity et al. | 188/33 |

* cited by examiner

*Primary Examiner*—Christopher P. Schwartz
(74) *Attorney, Agent, or Firm*—James Ray & Assoc.

(57) ABSTRACT

The present invention provides an improved TMX.RTM truck mounted brake assembly for applying a brake shoe force to a railway car wheels by interfacing with an axle motion III bogie. The improvement comprises a rack and pinion type hand brake mechanism integrally mounted on at least one truck bogie per railway car. The hand brake mechanism utilizes a plurality of gear/pinion arrangements to transmit the force applied at the drive wheel to the transfer lever disposed within the TMX.RTM truck mounted brake assembly to effect the brake application. The hand brake mechanism is disposed within the spatial confines of the TMX.RTM truck mounted brake assembly and axle motion III bogie. The brake beams of the brake assembly are of the open box construction to accommodate such hand brake mechanism. A visual indicator is provided to identify the hand brake in both fully applied and fully released positions.

27 Claims, 9 Drawing Sheets

HAND BRAKE ASSEMBLY FOR AN ANKLE MOTION III TRUCK BOGIE

CROSS-REFERENCE TO RELATED APPLICATIONS

This application is related to and claims priority from U.S. Provisional Patent Application Ser. No. 60/432,772 filed May 28, 2003. This application is further related to the invention taught in U.S. Pat. No. 6,305,504 titled "Suspension System for a Car Mounted Brake System", U.S. Pat. No. 6,279,696 titled "Suspension System for a Car Mounted Brake System", and U.S. Pat. No. 4,368,648 titled "Hand Brake for a Railroad Vehicle, all assigned to the assignee of the present invention. The teachings of U.S. Pat. Nos. 6,305,504, 6,279,696 and 4,368,648 are incorporated into this document by reference thereto.

FIELD OF THE INVENTION

The present invention relates, in general, to a brake assembly for a railway vehicle and, more particularly, this invention relates to a vertically suspended truck mounted brake assembly for an axle motion III bogie and, still more particularly, the instant invention relates to a truck mounted brake assembly for an axle motion III bogie having an integral hand brake for manual brake application.

BACKGROUND OF THE INVENTION

Car mounted hand brake mechanisms are well known in the railway industry. These hand brake mechanisms are normally mounted at one end of the railway car, remotely from the truck mounted braking system and typically include a hand wheel that is used to rotate a gear wheel to apply the brakes, and a housing having a back wall and a front wall, with a chain winding drum and a main gear wheel rotatably mounted on the housing.

A hand wheel shaft is also rotatably mounted on the housing and has a bearing section at one end and a hand wheel receiving section on the other end external to the housing. A ratchet wheel is rotatable with the shaft intermediate the ends of the shaft and a pawl is provided which cooperates with the ratchet wheel so as to prevent reverse rotation of the ratchet wheel. A freely rotatable pinion on the shaft engages the main gear wheel, the pinion having a radially extending flange cooperating therewith. A disengageable driving connection is provided between the radially extending flange and the ratchet wheel.

A trip cam is rotatably mounted in the housing and a trip bar, operable by the trip cam, cooperates with the radially extending flange to move the flange to disengage the driving connection and permit the pinion to freely rotate the main gear wheel for rotation in a brake releasing direction, accompanied by release of the chain winding drum and a chain wound on the chain winding drum to release the railway car handbrake.

The main gear wheel and chain winding drum comprise a main gear assembly, having a circular gear plate with gear teeth about its periphery, a central passageway through the gear plate, for mounting on a shaft, and a substantially square chain drum upon which the chain is wound.

The square chain drum has a longitudinal axis with a reduced diameter trunion at one end that is secured in the central passageway of the main circular gear plate. A shaft bore is provided through the square chain drum along its longitudinal axis and a drum shaft is mounted with a first end journaled in a back wall of the housing, such that the main gear assembly is freely rotatably mounted on the drum shaft. The front wall of the housing preferably has an upper section, an intermediate section extending outwardly away from the back wall, and a lower section extending downwardly from the intermediate section, with the drum shaft extending between the back wall and the lower section of the front wall.

The chain is typically coupled to a truck mounted braking system. One type of such truck mounted braking system is one which is commonly referred to as a TMX.RTM. truck mounted braking system (TMX.RTM. is a registered trademark of Westinghouse Airbrake Technologies, the assignee of the present invention). In this type system the chain is connected to the lever disposed within TMX.RTM. braking system for applying brake pressure through a series of linkages and levers.

Requirements for European railway industry hand brake mechanisms differ in that these mechanisms are mounted within the truck bogie (Axle Motion III) and thus become integral with the truck mounted braking system. These requirement further mandates that hand brake mechanisms are to be spatially confined to the envelope of the truck bogie.

SUMMARY OF THE INVENTION

An improved TMX.RTM truck mounted brake assembly is provided for applying a brake shoe force to railway car wheels by interfacing with an axle motion III bogie. The brake beams have been modified to an open box type construction versus traditional truss style brake beams to accommodate necessary brake shoe change out clearances and further accommodate an integrally mounted hand brake mechanism. Each brake beam includes a strut member extending outwardly and having a pivot. A brake actuator which is attached to the rod is disposed on one side of such strut pivot and a slack adjustor is disposed at the other side. A transfer lever provided at each brake beam pivotally connects the respective ends of the brake actuator and the slack adjustor and is further pivotally attached at such strut pivot. A brake shoe is attached to each side of each brake beam for applying a brake force to each wheel. A suspension system utilizing a plurality of linkages vertically suspends the brake assembly within the truck bogie to maintain a horizontal motion parallelogram and to also provide optimized brake shoe to wheel interface. The length, geometry and position of the links provide the same optimization during vertical displacement of the assembly either for an empty or loaded railway car.

The hand brake mechanism is of a rack and pinion type and comprises a housing having a mounting means for attachment to the brake assembly. A manually operable drive mechanism is disposed within such housing and includes a drive shaft with a drive pinion which meshes with at least one transfer gear and pinion set. Either one or two drive wheels are provided on the sides of the truck bogie for manually applying a brake shoe force. A rack is further provided for meshing with such transfer gear and pinion set in order to transfer a torque and force applied by the drive wheel to the transfer lever connected to the brake actuator for effecting such brake shoe force application. A clutch mechanism is cooperatively connected with the manually operable driving mechanism and is operable upon rotation thereof in one direction and upon buildup of force therein for effecting the brake application, to an engaged disposition in which the driving mechanism is constrained from rotation in the opposite direction by the ratchet and holding pawl arrangement and thereby maintaining such brake application until released. A sensor provides a signal to notify a train operator when the hand brake has been fully released. A visual identification means having a truck frame mounted housing containing an indicator is provided. Such visual identification means is connected to the rack via a cable for visual identification of the hand brake in a fully set position.

OBJECTS OF THE INVENTION

It is, therefore, one of the primary objects of the present invention to provide a brake assembly which provides all of the advantages of the existing TMX-VS-III design with applications to European style track friendly bogies (Axle Motion III).

Another object of the present invention is to provide a brake assembly which provides a beam/bogie mounted hand brake mechanism.

Yet another object of the present invention is to provide a brake assembly which provides a means of applying a brake shoe force to wheels by interfacing and operating within the spatial confines of an existing Axle Motion III bogie which utilizes gear-pinions.

Still another object of the present invention is to provide a means of applying a brake shoe force to wheels by interfacing and operating within the confines of an existing Axle Motion III bogie which utilizes a rack style hand brake mechanism.

A further object of the present invention is to provide a means of visually identifying the hand brake application.

An additional object of the present invention is to provide an electrical sensor means for notifying the train operator that the hand brake has been fully released without having to physically check the hand brake.

In addition to the numerous objects and advantages of the present invention which have been described with some degree of particularity above, it should be both noted and understood that a number of other important objects and advantages of the invention will become more readily apparent to those persons who are skilled in the relevant art from the following more detailed description of the invention, particularly, when such detailed description is taken in conjunction with the attached drawing figures and with the appended claims.

Figure 1:
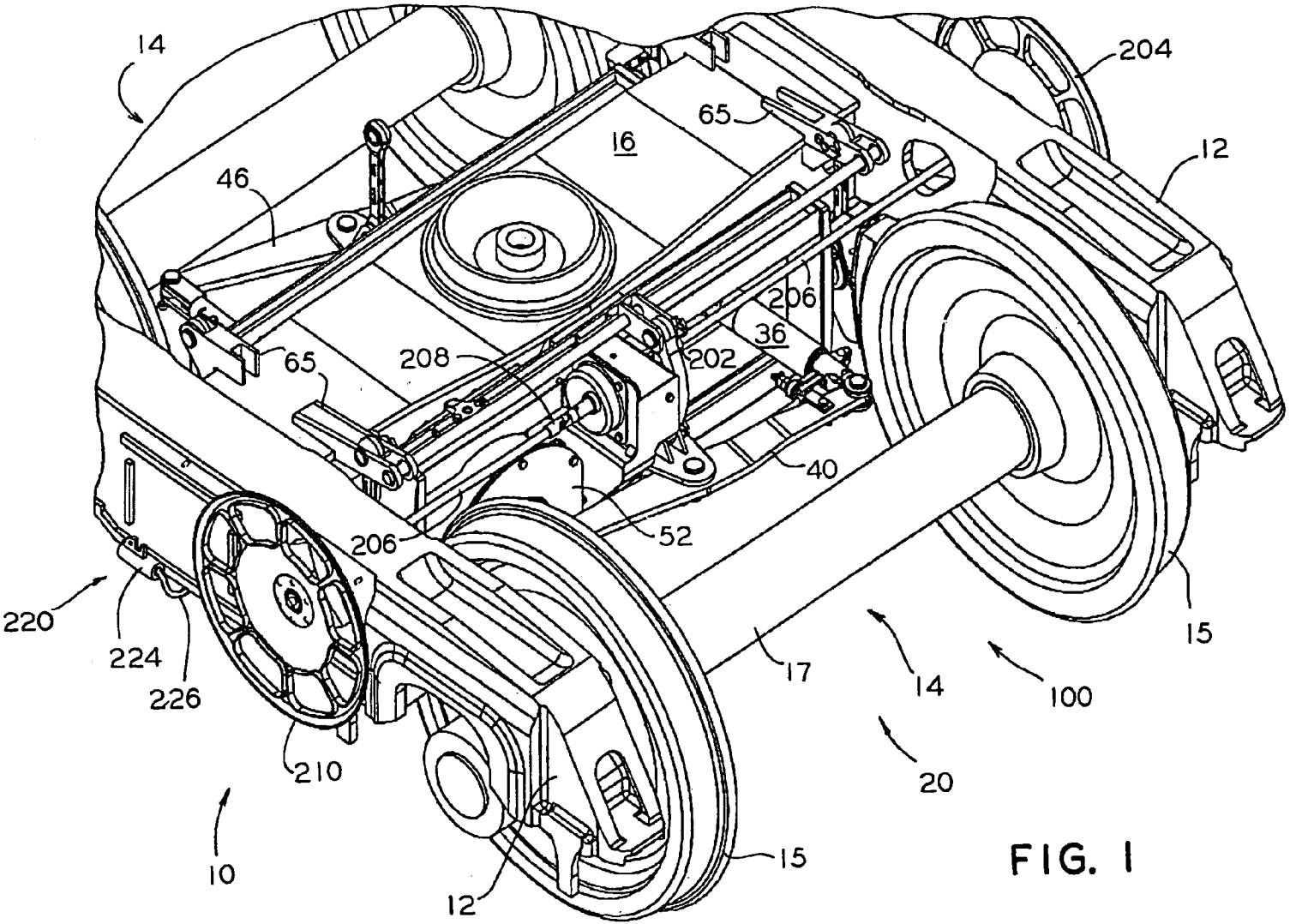
FIG. 1 is a partial perspective view of a truck mounted vertically suspended (TMX-VS-III) brake assembly with a hand brake applied to Axle Motion III bogie.

BRIEF DESCRIPTION OF THE PRESENTLY PREFERRED AND VARIOUS ALTERNATE EMBODIMENTS OF THE PRESENT INVENTION

Prior to proceeding to the more detailed description of the present invention, it should be noted that for the sake of clarity and understanding of the invention, identical components with identical functions have been designated with identical reference numerals throughout the drawing Figures.

Referring now, more particularly, to FIG. 1 there is shown a presently preferred embodiment of a bogie mounted brake assembly, generally designated 20, which is vertically suspended within an Axle Motion III truck bogie, generally designated 10. The Axle Motion III truck bogie 10 comprises a pair of bogie side frames 12, a wheel and axle set, generally designated as 14, at each end of the bogie side frames 12 and a bogie bolster member 16.

Figure 2:
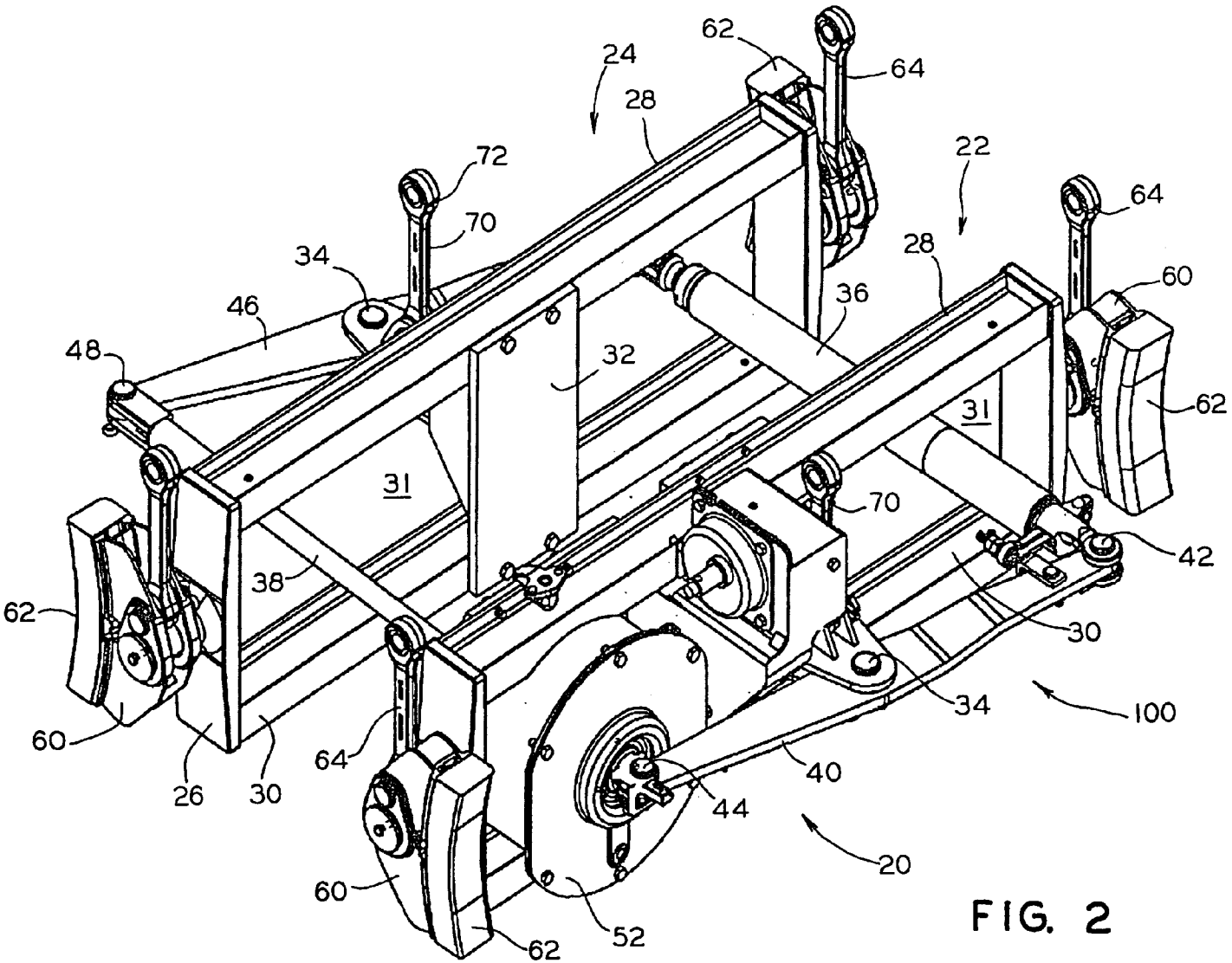
FIG. 2 is a perspective view of a truck mounted vertically suspended (TMX-VS-III) brake assembly equipped with a hand brake.
Figure 3:
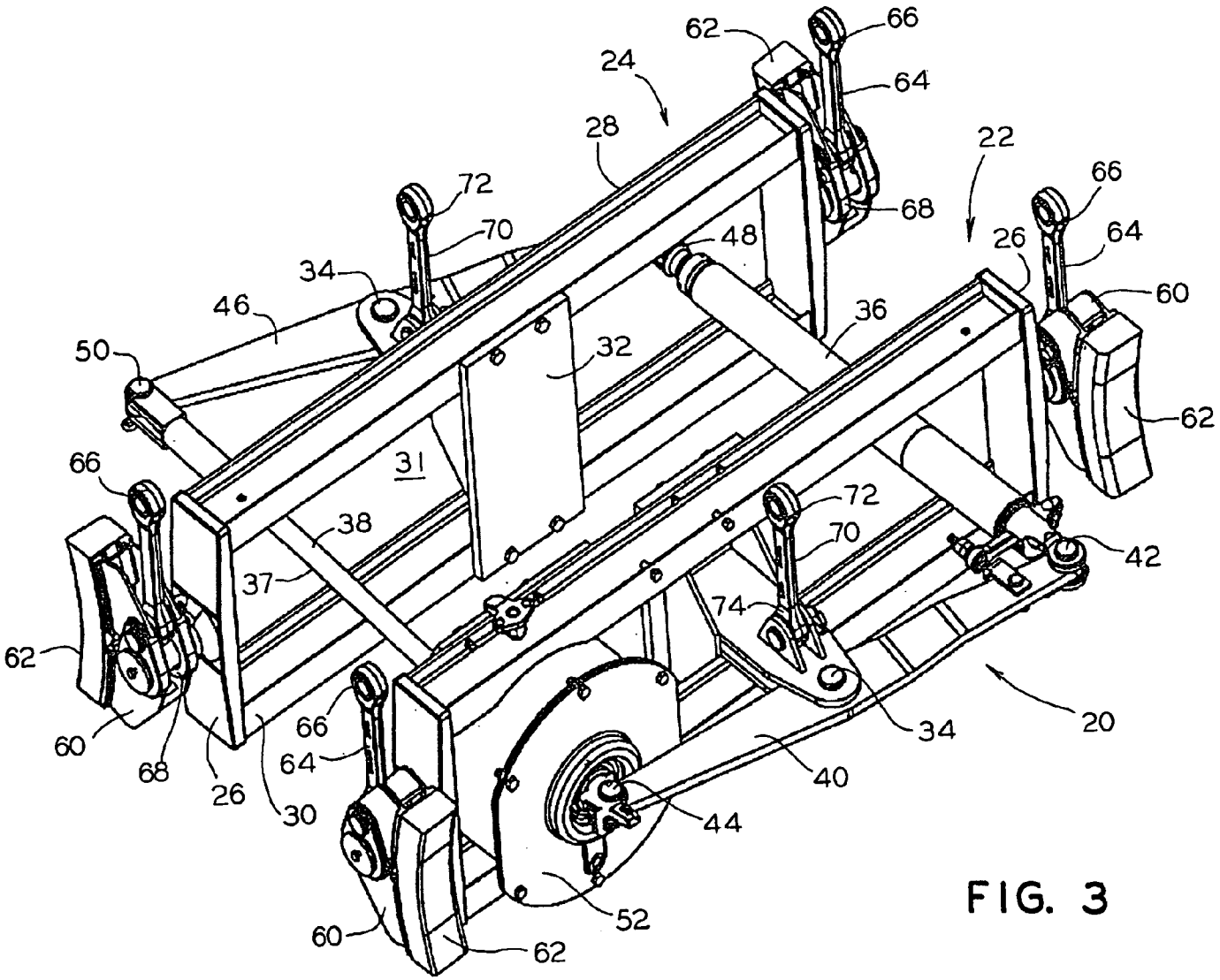
FIG. 3 is a perspective view of a truck mounted vertically suspended (TMX-VS-III) brake assembly without a hand brake.
Figure 4:
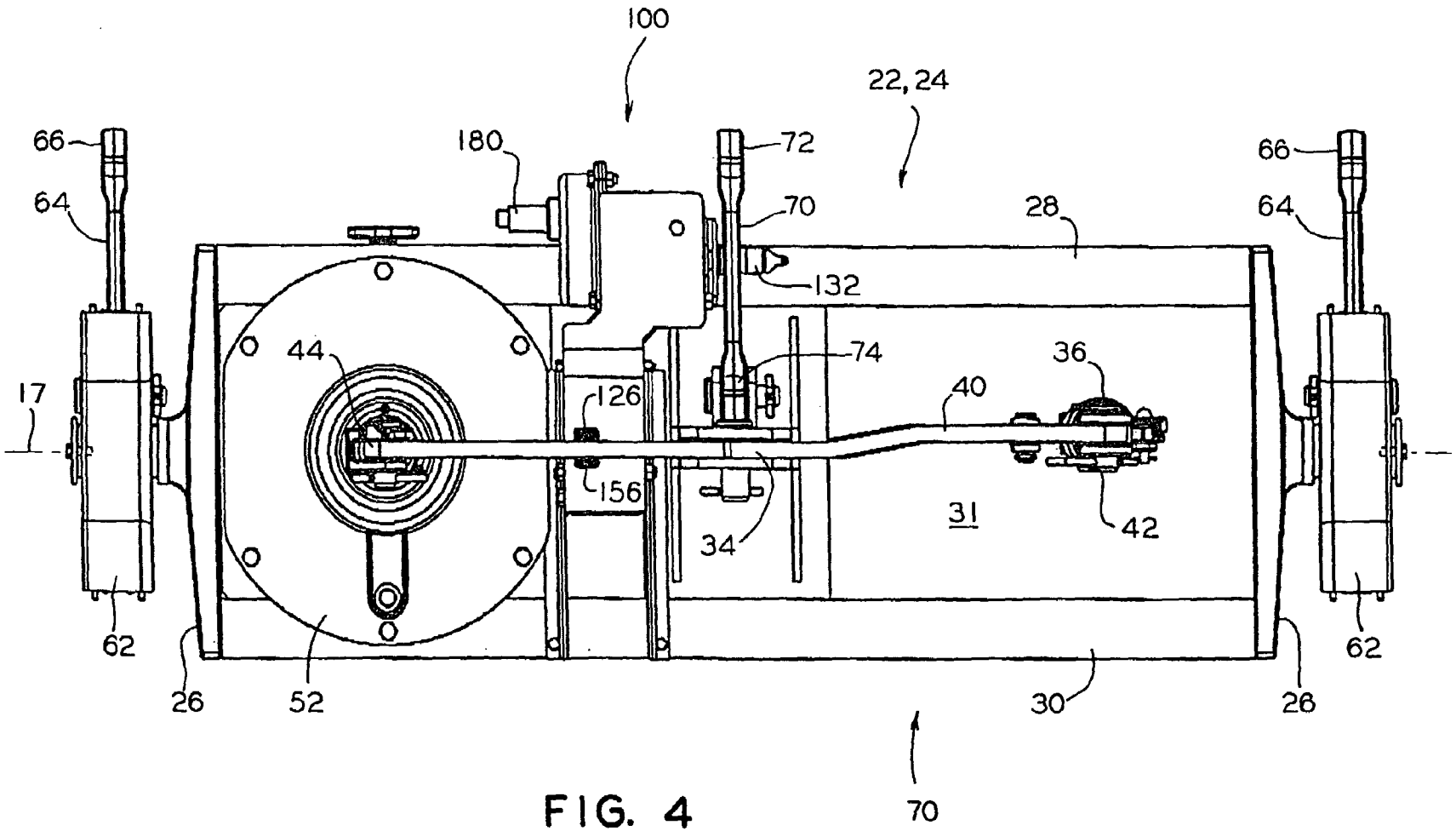
FIG. 4 is a side planar elevation view of a truck mounted vertically suspended (TMX-VS-III) brake assembly.

The truck bogie mounted brake assembly 20 is best illustrated in FIGS. 2–4. This particular truck mounted brake assembly 20 includes a pair of brake beams, generally designated 22 and 24. Each of the pair of brake beams 22 and 24 is disposed symmetrical with the horizontal plane force path as related to a centerline 17 of the wheel and axle set 14 for optimized brake shoe to wheel interface.

To meet the functional and spatial requirements of the Axle Motion III bogie in general and brake shoe change out clearances in particular, each brake beam 22 and 24 comprises a pair of side members 26, a top member 28, and a bottom member 30. The top and the bottom members 28 and 30, respectively, join respective ends of the side members 26 to form an aperture 31 within each one of the brake beams 22 and 24.

A strut member 32 having a pivot 34 is securable with each of the brake beams 22 and 24. It is presently preferred that such pivot 34 extend outwardly from each brake beam 22 and 24 toward each wheel and axle set 14. A first transfer lever 40 having a first end 42 and a second end 44 is pivotally connected to the first brake beam 22 at the pivot 34 and a second transfer lever 46 having a first end 48 and a second end 50 is pivotally connected to the second brake beam 24 at the pivot 34. Corresponding ends of the transfer levers 40 and 46 are pivotally interconnected through force transmitting members 36 and 37. Preferably such first and second transfer levers 40 and 46, respectively, are disposed in the horizontal plane formed by the longitudinal axis 17 of each wheel and axle set 14. Force transmitting member 36 may be a simple connecting rod or, as shown here, a slack adjuster device disclosed in U.S. Pat. No. 4,662,495, assigned to the assignee of the present invention.

Force transmitting member 38 includes a brake actuator 52, preferably of a pneumatic actuator type, rigidly connected to a simple connecting rod 38 at one end and pivotally connected to the second end 44 of the first transfer link 40. The simple connecting rod 38 is further pivotally connected to the second end 50 of the second transfer lever 46. A plurality of brake heads 60 are attached to each end 26 of each of the brake beams 22 and 24. Each of the brake heads 60 carry a brake shoe 62 thereon and are positioned for engagement of a respective one of the brake shoes 62 with a respective railway vehicle wheel 15 during a brake application.

A suspension system is provided for vertically suspending the truck mounted brake assembly 20 within the railway car truck bogie arrangement 10. This suspension system generally comprises a first means 64 pivotally connected at a first end 66 with a predetermined portion of the railway vehicle truck arrangement 10 and pivotally connected at a second end 68 with a predetermined portion of the truck mounted brake assembly 20 for suspending the pair of brake beams 22 and 24 in the railway vehicle truck arrangement 10. A second means 70 is provided which includes a first end 72 pivotally connected with a predetermined portion of the railway vehicle truck arrangement 10 and a second end 74 pivotally connected with either each of the pair of brake beams 22 and 24 or each of the strut members 32. Second means 70 maintains each of the brake beams 22 and 24 in a predetermined plane during application and release of the railway vehicle brake assembly 20.

Such suspension arrangement maintains a horizontal motion parallelogram and also provides an optimized brake shoe to wheel interface. The length, geometry and position of the links provide the same optimization during vertical displacement of the assembly either for an empty or loaded railway car.

Alternatively the suspension system may be selected from various preferred and alternative embodiments disclosed in U.S. Pat. Nos. 6,305,504 and 6,279,696.

The suspension system may also include a plurality of hanger brackets 65 rigidly attached to the bolster 16 and having a pivotal connection with a first end 66 of the first means 64 and a first end 72 of the second means 70.

Figure 5:
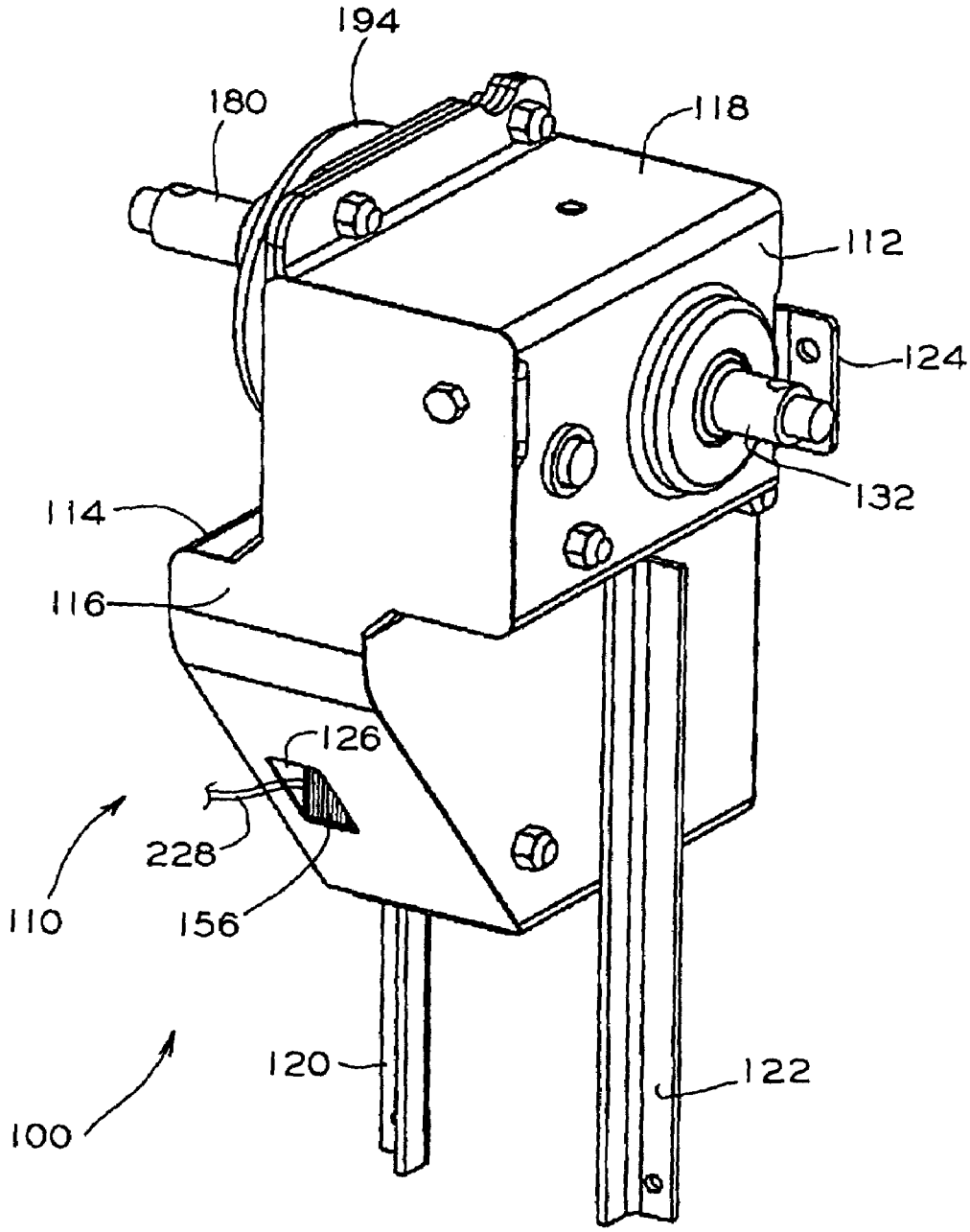
FIG. 5 is a perspective view of the hand brake mechanism.
Figure 6:
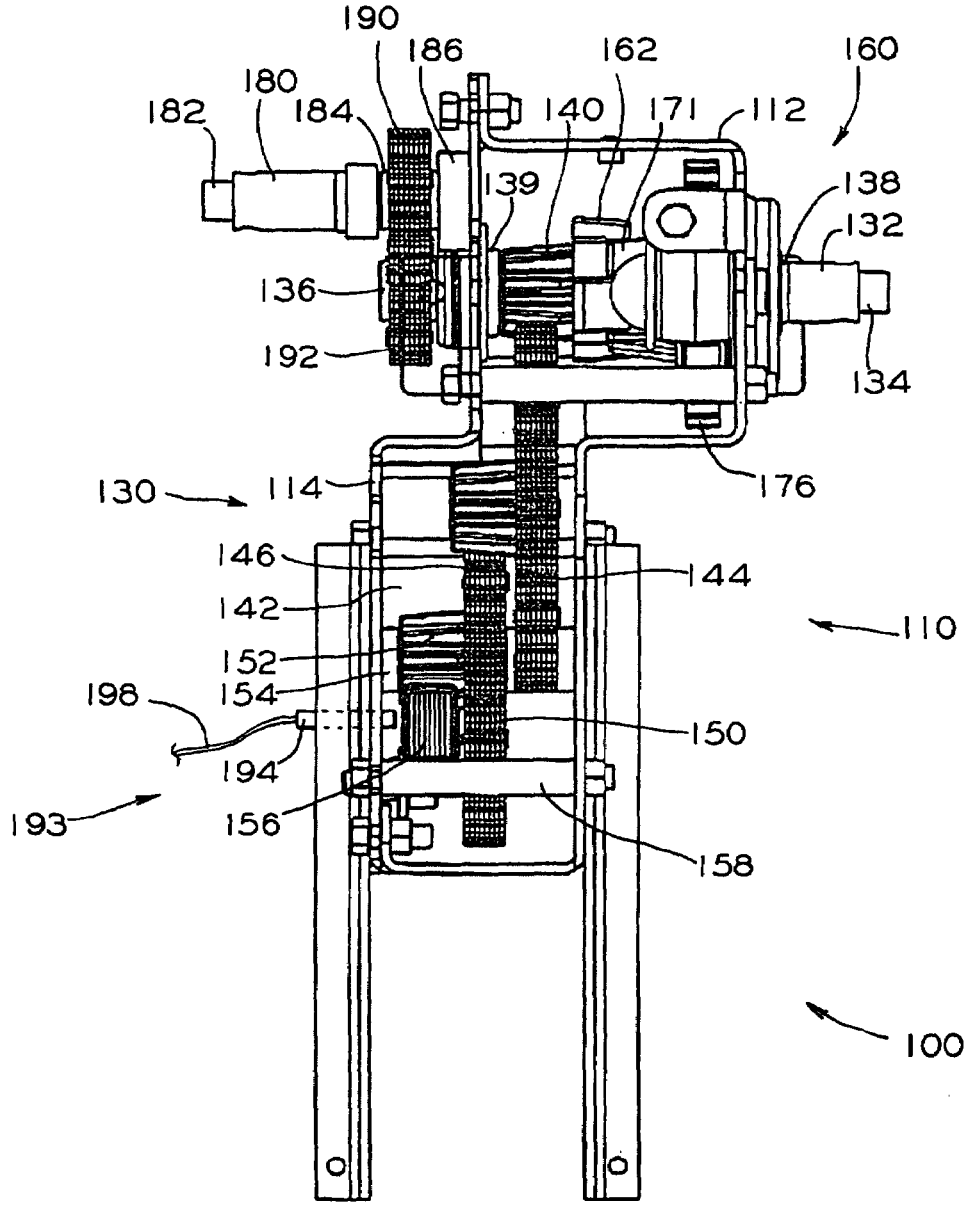
FIG. 6 is a side elevation view of the hand brake mechanism, particularly showing the components of the drive mechanism.

As illustrated in FIGS. 5 and 6, a hand brake mechanism, generally designated 100, is preferably attached to one of the brake beams 22. The hand brake mechanism comprises a housing, generally designated 110, having a front wall 112, a rear wall 114, a first side 116, and a second side 118. A first member 120 and preferably a second member 122 and a third member 124 which provide a mounting means to the brake beam 22.

A manually operable driving means, generally designated 130, of a rack-and-pinion type is disposed in the housing 110. Such manually operable driving means 130 has a first drive shaft 132 having a first end 134 and a second end 136. Such first drive shaft 132 is journaled for rotation in bearings 138 and 139 secured in front wall 112 and rear wall 114, respectively. Such first drive shaft 132 is coupled with a first drive rod 200 at such first end 134 via a first coupling means 202. The first drive rod 200 is connected to a first drive wheel 203 which is mounted on the side of one of the bogies 12.

A drive pinion 140 is secured on the first drive shaft 132, for rotation therewith, near the second end adjacent bearing 139. Such drive pinion 140 engages a first transfer gear 144 which is secured to a first transfer shaft 146 adapted for rotation within housing 110. A first transfer pinion 142 is further secured to the first transfer shaft 146. Preferably, first transfer pinion 146 is integral to such first transfer gear 144. It is further preferred that the first transfer pinion 146 be engaged with a second transfer gear 150 which is secured to a second transfer shaft 154 adapted for rotation within housing 110.

The second transfer pinion 152 is further secured to the second transfer shaft 154. Preferably, second transfer pinion 152 is integral to such second transfer gear 150. Another essential feature of the manually operable driving means 130 is a rack 156 which is adapted for reciprocal linear motion within housing 110. Such rack 156 engages with either the first or the second transfer gear 144 or 150, respectively, at its top surface to be driven thereby during hand brake 100 application and release.

At least one guide roller 158 is rotatably attached to such housing 110 and supports a bottom surface of the rack 156. As best illustrated in FIGS. 4 and 5, such rack 156 extends through aperture 126 disposed within the right wall 116 and having a first end thereof contacting such first transfer lever 40 intermediate its second end 44 and the pivot 34 during the application of the hand brake 100.

Also disposed in the upper portion of housing 110 and associated with the manually operable driving means 130, is a clutch mechanism, generally designated 160. Clutch mechanism 160 comprises an annular stationary cam member 162 which is restrained from both an axial and a rotational movement, and a movable cam member 164 (not shown) which is rotatably disposed concentrically within such stationary cam 162, the movable cam (not shown) being rotatable relative to the stationary cam member 162 by means of complementary fast pitch threads (not shown) formed thereon.

An internally splined annular clutch collar (not shown) is provided with an annular flange (not shown) and concentrically surrounds the drive shaft 132, such collar engaging with an externally splined nut 171 coupled to a threaded portion (not shown) of the drive shaft 132.

Figure 7:
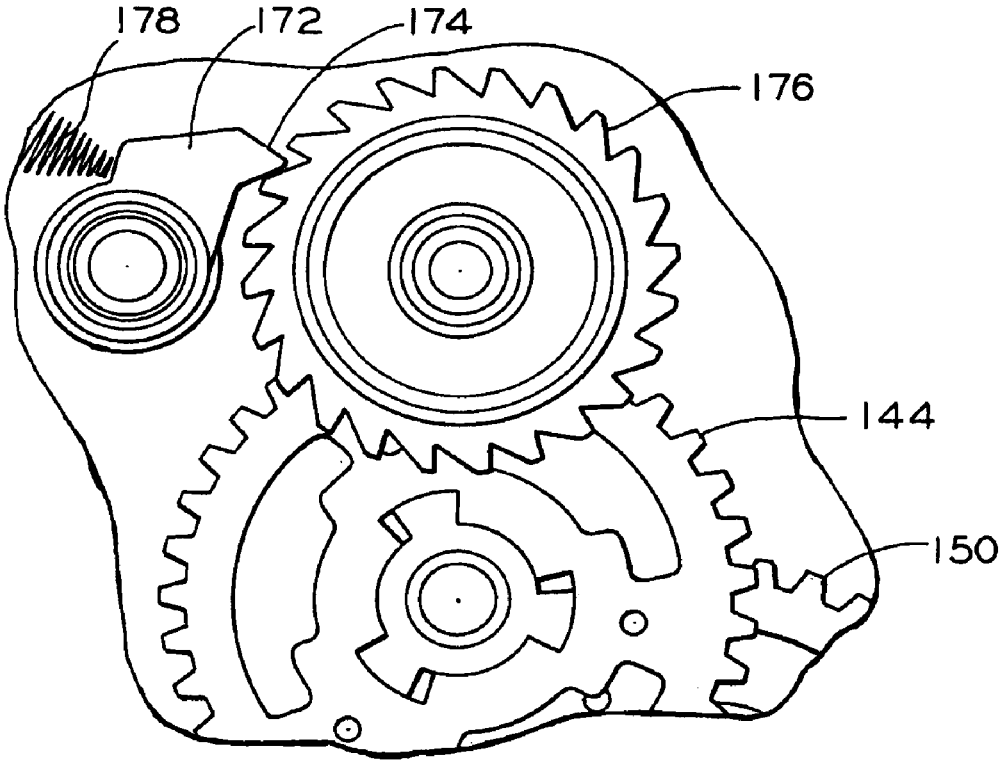
FIG. 7 is a partial side elevation view of the hand brake mechanism, particularly showing the holding pawl and ratchet wheel of the clutch mechanism.
Figure 8:
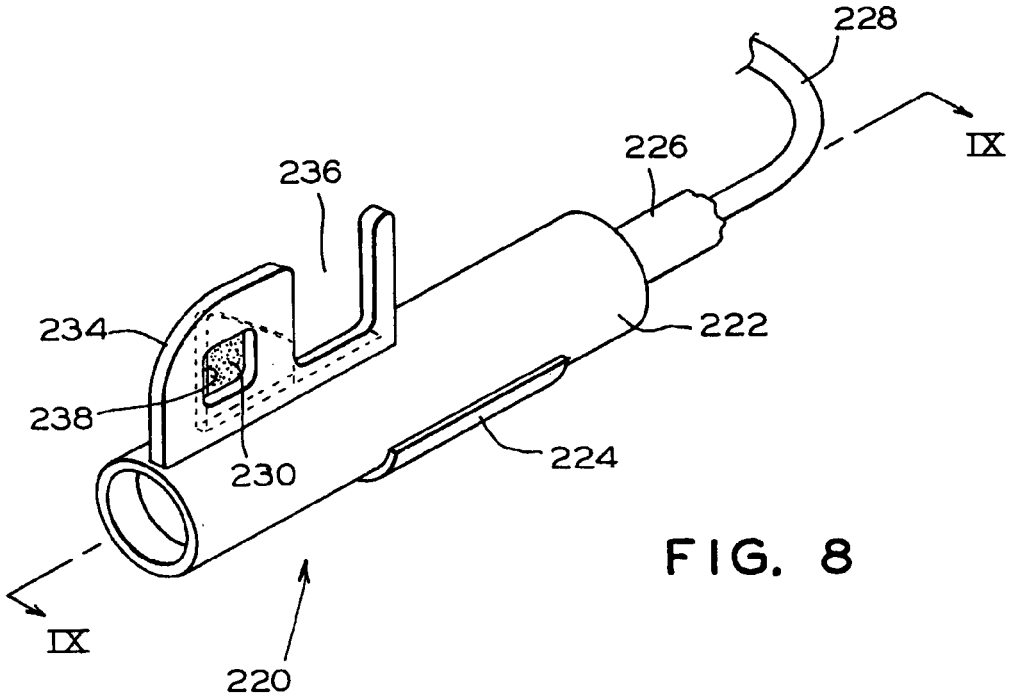
FIG. 8 is a perspective view of the visual indicating means connected to the hand brake.
Figure 9:
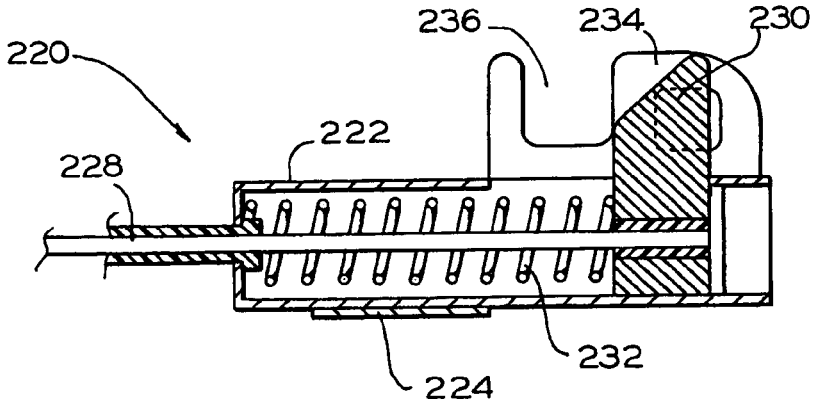
FIG. 9 is a partial cross-sectional view of the visual indicating means taken along lines 9—9 in FIG. 8.

As best illustrated in FIG. 7, a holding pawl 172, which is pivotally mounted to the upper portion of the housing 110, has a ratchet engaging portion 174 engaging ratchet wheel 176. The holding pawl 172 is free to ratchet thereon upon rotation of such ratchet wheel 176 in a clockwise direction. A spring 178 biases the holding pawl 172 toward such ratchet wheel 176.

The hand brake mechanism 100 may further comprise a second drive shaft 180 having a first end 182 and a second end 184. Such second drive shaft 134 is journaled for rotation in bearing 186 secured in the rear wall 114. Such second drive shaft 180 is for coupling with a second drive rod 206 at its first end 182 via a second coupling means 208. The second drive rod 206 is connected to a second drive wheel 210 which is mounted on the side of the other bogie 12. A second adaptor gear 190 rotatably secured to such second drive shaft 180 engages a first adaptor gear 192 rotatably secured to the second end 136 of first drive shaft 132 for applications requiring identical rotation of the first and second drive wheels 204 and 210 with respect to a person turning such drive wheels. To maintain substantially identical rotation forces such first and second adaptor gears 190 and 192, respectively, are substantially identical.

Preferably such first and second coupling means 202 and 208, respectively, are of a well-known universal joint type to accommodate misalignment due to component and assembly tolerances and to accommodate lateral movement of at least one of the brake beams 22 and 24 at one of the drive shafts 132 and 180.

An electronic sensor, generally designated 193, is best illustrated in FIG. 6. Such electronic sensor 193 comprises a sensing means 194 disposed in the predetermined position near the second side 118 of the housing 110 for detecting a second end of rack 156 when such second end is disposed near the second side 118 in the fully released position. Such sensing means 194 has an electrical connection 198 for providing at least one signal to a railway vehicle control system (not shown) to notify a train operator that the hand brake is in a fully released position. Such electronic sensor 193 may further comprise a sensing activation means (not shown) which can be attached to, or imbedded in, the rack 156 for enabling such at least one signal.

In a particular reference to FIGS. 1, 5, 8, and 9, there is illustrated at least one visual indicating means, generally designated 220, which is attached to the bogie side frame 12 for visually indicating such hand brake 10 in either a fully released or a fully deployed position. Preferably, such at least one visual indicating means comprise an indicator housing 222 having a mounting portion 224 for attachment to the bogie side frame 12. A conduit 226 is secured to a first end of such indicator housing 222 for encasing a cable 228 which is attached to the first end of the rack 156 at one end and is attached to an indicator 230 at its second end. The indicator 230 is adapted for longitudinal axial movement within the indicator housing 222 and is biased toward a second end thereof with a spring 232. An indicating bracket 234 is attached to the indicator housing 222 near its second end. Such indicating bracket 234 has a slot 236 of a predetermined width and length and a cavity 238 disposed opposite such indicator 230. It will be understood that such indicator 230 can be viewed through the cavity 238 when the hand brake 100 is in its fully released position.

It is further presently preferred that such indicator 230 has a coating 240 disposed on the side thereof adjacent such indicating bracket 234 which is easily recognizable from a distance. It is additionally preferred that the color of such coating 240 will differ from the color of the truck bogie side frame 12. In the most preferred embodiment, a reflective coating 240 is applied to such indicator 230 for ease of identification during darkness or nightfall, with the use of a flashlight like device. In the preferred embodiment such at least one visual indicating means 220 is a pair of visual indicating means 220 attached to each bogie side frame 12.

As is best illustrated in FIG. 1, the brake assembly 20 and the hand brake mechanism 100 are disposed substantially within the confines of the truck bogie 10.

Those skilled in the art would appreciate usage of only one hand brake mechanism per railway car (not shown) in combination with a car mounted brake assembly taught in U.S. Pat. No. 6,305,504. In order to accomplish this, such first, second, and third mounting means 120, 122, and 124, respectively, may be adapted for mounting to the structure of such railway car (not shown) to enable disposition of the hand brake mechanism 100 adjacent the brake actuator. The rack 156 will than transfer a force generated through the hand brake mechanism 100 to one of the transfer levers connected to the brake actuator thus effecting a brake application at each of the pair of truck mounted brake assemblies, essentially consisting of a pair of brake beams and a plurality of brake shoes.

In operation, in order to apply a block force to each of the wheels 15, either the first drive wheel 204 or the second drive wheel 210 is rotated in a clockwise direction to apply the force to the first drive shaft 132 and clutch mechanism 160. Initially the first drive shaft 132, externally splined nut 171, internally splined clutch collar (not shown) all rotate as a unit. The drive pinion 140 will transmit the applied force to the first transfer gear 144. This applied force will ultimately be transmitted to the rack 156 causing linear movement thereof through the aperture 126 and further causing the rack 156 to contact the first transfer lever 40 at a predetermined point between the strut pivot 34 and the second end 44 of the first transfer lever 40. Continuing movement of the rack 156 enables rotation of the first transfer lever 40 in the counter-clockwise direction, as shown in FIGS. 1–3, to enable the rotation of the second transfer lever 46 and further enable contact of each one of the brake shoes 62 with each such wheel 15. During brake application the rack 156 applies a pull force onto cable 228 of the visual indicating means 220 enabling viewing of the indicator 234 through the slot 236, thus providing visual indication that the brake force has been fully applied.

As the force in the manually operable driving means 130 begins to build up, such force tension is transmitted back through drive pinion 140 to a clutch collar (not shown). Resistance to rotation by the clutch collar, which is splined to nut 171, causes nut 171 to advance on threads (not shown) and clamp a ratchet wheel 176. With ratchet wheel 176 so clamped, continued rotation of either drive wheel 204 or 210 causes the first drive shaft 132, the ratchet wheel 176, and nut 171 to rotate as a single unit until the desired force is attained on rack 156, while holding pawl 172 ratchets on said ratchet wheel 176. When the desired force has been achieved on rack 156, rotation or application of torque on either the first drive wheel 204 or the second drive wheel 210 is terminated, and the holding pawl 172 engaged on clamped ratchet wheel 176 prevents the rack 156 from moving in an opposite direction, since the holding pawl 172 permits only clockwise rotation of said ratchet member, as best shown in FIG. 7.

For effecting a gradual release of the brakes, either the first drive wheel 204 or the second drive wheel 210 is rotated in a counter-clockwise direction to partially loosen nut 171 and thereby reduce the clamping force on ratchet wheel 176, which is restrained from rotation by holding pawl 172. The initial counterclockwise rotation of either the first drive wheel 204 or the second drive wheel 210 effects a corresponding rotation of the drive pinion 140, thereby easing tension on rack 156. Continued counterclockwise rotation of either the first drive wheel 204 or the second drive wheel 210 effects complete return of the rack 156 to its normal position within the housing 110 and removes the force from the first transfer lever 40 which enables each brake shoe 62 to move away from the wheel 15. When the hand brake 100 has been fully released, the indicator 230 returns to its normal position under the force from the bias spring 232 and is visible through the cavity 238 of the visual indicating means 220. Furthermore, with the hand brake 100 in its fully released position the electronic sensor 193 provides a signal to the railway vehicle control system (not shown).

Figure 10:
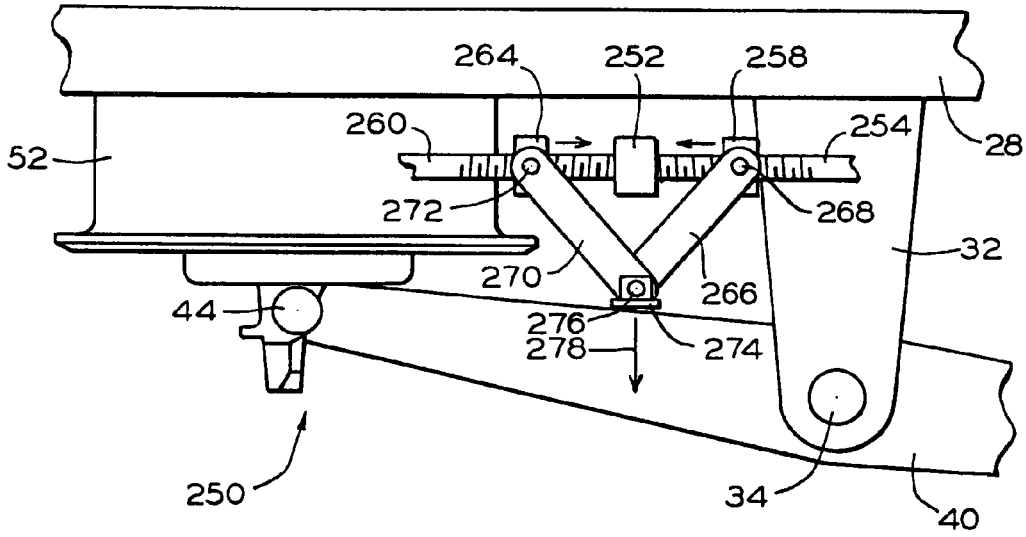
FIG. 10 is a partial top view of a first alternative embodiment of the drive mechanism.
Figure 11:
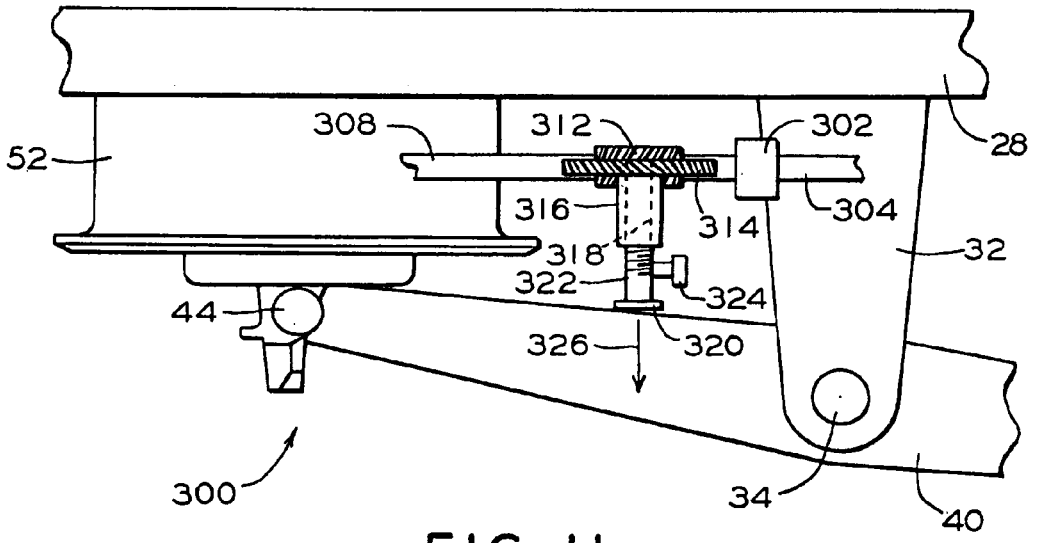
FIG. 11 is a partial top view of a second alternative embodiment of the drive mechanism.

The alternative embodiments of the manually operable driving means 130 are illustrated in FIGS. 10 and 11.

The first alternative of the manually operable driving means, generally designated 250, is illustrated in FIG. 10 and comprises a stationary disposed housing 252, a first lead screw 254 having a left hand thread and rotatably journaled in such housing 252 at one end and connected to the coupling means 202 at its distal end, and a second lead screw 260 having a right hand thread and rotatably journaled in such housing 252 and connected to coupling means 208 at its distal end. A first drive nut 258 is coupled to such first lead screw 254 to be linearly driven toward such housing 252 upon rotation of the first drive wheel 204 in the clockwise direction. A second drive nut 268 is coupled to such second lead screw 260 to be linearly driven toward such housing 252 upon rotation of the second drive wheel 210 in the clockwise direction. Such first and second drive screws 254 and 260, respectively, are rigidly coupled within such housing 252 to enable linear movement of each of the first and second drive nuts 258 and 264, respectively, upon rotation of one of the drive wheels 204 and 210. A first link 266 is pivotally attached to the first drive nut 258 at a first pivot 268 and a second link 270 is pivotally attached to the second drive nut 264 at a second pivot 272. Such links 266 and 270 are pivotally attached to each other and further pivotally attached to a ram 274 at a third pivot 276. Those skilled in the art would appreciate linear movement of such ram 274 in the direction 278 to displace first lever 40 for brake application upon rotation one of the first and second drive wheels 204 and 210, respectively.

The second alternative of the manually operable driving means, generally designated 300, is illustrated in FIG. 11 and comprises a stationary disposed housing 302, a first lead screw 304 having a left hand thread and rotatably journaled in such housing 302 at one end and connected to the coupling means 202 at its distal end, and a second lead screw 308 having a right hand thread and rotatably journaled in such housing 302 and is connected to the coupling means 208 at its distal end. A worm gear disposed integrally on one of the lead screws is coupled with a wheel gear 314 having an axially disposed member 316 with an axially disposed threaded cavity 322. A ram 320 having a threaded member 322 engaging such threaded cavity 318 is adapted for linear movement in direction 326 and constrained from rotation by a stop member 324. Such first and second drive screws 304 and 308, respectively, are rigidly coupled within such housing 302 to enable rotation of such worm gear 312 upon actuation of either drive wheel 204 or 210. The rotation of the worm gear 312 transferred through the wheel gear 314 will enable linear movement of the ram 320 in the direction 326 to displace first lever 40 for brake application upon rotation one of the first and second drive wheels 204 and 210, respectively.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A hand brake mechanism for manually applying a brake shoe force to effect a brake application to at least one wheel of a railway vehicle, said hand brake mechanism comprising:

(a) a housing including a front wall, a rear wall, a first side having an aperture, a second side disposed opposite said first side, and at least one mounting member;

(b) a manually operable driving means disposed within said housing and rotatable in one direction for applying and in an opposite direction for releasing said brake shoe force; and (c) a clutch mechanism cooperatively connected with said manually operable driving means and operable upon rotation thereof in said one direction and upon a buildup of force therein for effecting said brake application, to an engaged disposition in which said manually operable driving means is constrained from rotation in said opposite direction and thereby maintaining said brake application until released.

2. A hand brake mechanism, as set forth in claim 1, wherein said housing further includes a second and a third mounting member.

3. A hand brake mechanism, as set forth in claim 1, wherein said manually operable driving means includes:

(a) a first drive shaft having a first end, a second end and a screw-threaded portion, said first drive shaft is journaled for rotation in a first and a second bearing secured in said front wall and said rear wall, respectively;

(b) a drive pinion secured near said second end of said first drive shaft for rotation therewith;

(c) a first drive wheel mounted remotely from said housing for applying a force and a torque to said first drive shaft;

(d) a first drive rod connected to said first drive wheel at one end and connected to said first end of said first drive shaft via a coupling means at a distal end;

(e) a first transfer shaft adapted for rotation within said housing;

(f) a first transfer gear coaxially secured to said first transfer shaft for rotation therewith, said first transfer gear meshing with said drive pinion;

(g) a rack adapted for reciprocal linear motion within said housing, said rack having a top surface for meshing with said first transfer gear, said rack for transferring a force applied by said first drive wheel for effecting said brake application, said rack extending through said aperture of said first side of said housing during said brake application; and (h) at least one guide roller rotatably disposed within said housing for supporting a bottom surface of said rack.

4. A hand brake mechanism, as set forth in claim 3, wherein said manually operable driving means further includes:

(a) a first transfer pinion coaxially secured to said first transfer shaft adjacent said first transfer gear;

(b) a second transfer shaft adapted for rotation within said housing;

(c) a second transfer gear coaxially secured to said second transfer shaft for rotation therewith, said second transfer gear meshing with said first transfer pinion; and (d) a second transfer pinion coaxially secured to said second transfer shaft adjacent said second transfer gear, said second transfer pinion for meshing with said top surface of said rack.

5. A hand brake mechanism, as set forth in claim 4, wherein said first transfer pinion is integral with said first transfer gear.

6. A hand brake mechanism, as set forth in claim 4, wherein said second transfer pinion is integral with said second transfer gear.

7. A hand brake mechanism, as set forth in claim 3, wherein said manually operable driving means further includes:

(a) a second drive shaft having a first end and a second end, said second drive shaft journaled for rotation in a bearing secured in said rear wall;

(b) a second drive wheel mounted remotely from said housing for applying a force and a torque to said second drive shaft;

(c) a second drive rod connected to said second drive wheel at one end and connected to said first end of said second drive screw via a coupling means at a distal end;

(d) a first adaptor gear secured to said second end of said first drive shaft for rotation therewith; and (e) a second adaptor gear secured to said second end of said second drive shaft for rotation therewith; said second adaptor gear for meshing with said first adaptor gear.

8. A hand brake mechanism, as set forth in claim 7, wherein said first and said second drive wheels are rotatable in a substantially identical direction in respect to a person applying such rotation to apply and release said brake shoe force.

9. A hand brake mechanism, as set forth in claim 7, wherein said second adaptor gear is substantially identical to said first adaptor gear.

10. A hand brake mechanism, as set forth in claim 1, wherein said manually operable driving means includes:

(a) a first drive screw having a left hand thread and rotatably journaled in said housing at one end and connected to a first coupling means at a distal end thereof;

(b) a second drive screw having a right hand thread and rotatably journaled in said housing and connected to a second coupling means at a distal end thereof;

(c) a first drive nut coupled to said first drive screw to be linearly driven toward said housing upon rotation of a first drive wheel in a clockwise direction;

(d) a second drive nut coupled to said second drive screw to be linearly driven toward said housing upon rotation of a second drive wheel in a clockwise direction;

(e) a first link pivotally attached to said first drive nut at a first end thereof;

(f) a second link pivotally attached to said second drive nut at a first end thereof, said second link pivotally attached to said first link at a second end thereof; and (g) a ram pivotally attached to said second end of each of said first and said second links, said ram adapted for reciprocal linear movement for transferring a force applied by one of said first drive wheel and said second drive wheel for effecting said brake application.

11. A hand brake mechanism, as set forth in claim 10, wherein said first drive screw is rigidly coupled to said second drive screw within said housing for enabling linear movement of each of said first and said second drive nuts upon rotation of one of said first and said second drive wheels.

12. A hand brake mechanism, as set forth in claim 1, wherein said manually operable driving means includes:

(a) a first drive screw having a left hand thread and rotatably journaled in said housing at one end and connected to a first coupling means at a distal end thereof;

(b) a second drive screw having a right hand thread and rotatably journaled in said housing and connected to a second coupling means at a distal end thereof;

(c) a worm gear disposed integrally on one of said first and said second drive screws;

(d) a wheel gear adapted for meshing with said worm gear, said wheel gear having an axially disposed member with an axially disposed threaded cavity;

(e) a ram having a threaded member engaging said threaded cavity of said wheel gear, said ram adapted for reciprocal linear movement for transferring a force applied by one of a first drive wheel and a second drive wheel for effecting said brake application; and (f) a stop member engaging said ram for preventing a rotational movement thereof.

13. A hand brake mechanism, as set forth in claim 12, wherein said first drive screw is rigidly coupled to said second drive screw within said housing for enabling rotation of said worm gear upon rotation of one of said first and said second drive wheels.

14. A hand brake mechanism, as set forth in claim 1, wherein said clutch mechanism includes a ratchet wheel rotatable along with said manually operable driving means and cooperative with a spring biased holding pawl, upon termination of manual effort on said manually operable driving means for retaining thereof and said brake application in a state of equilibrium, said clutch mechanism further including a clutch collar rotatably engaged with a splined nut coupled to a threaded portion of a drive shaft, an annular stationary cam member secured in fixed coaxial surrounding relation to said drive shaft adjacent the end to which a drive pinion is secured, an annular movable cam disposed coaxially with and in surrounding relation to said stationary cam and being connected therewith by complementary fast pitch threads formed partly on said stationary cam and partly on said movable cam.

15. A hand brake mechanism, as set forth in claim 1, further comprising at least one visual indicating means attached to one of a pair of bogie side frames for visually indicating said hand brake mechanism in one of a fully released and a fully applied position, said at least one visual indicating means including:

(a) an indicator housing having a mounting portion for attachment to said one of said pair of bogie side frames;

(b) an indicator adapted for longitudinal linear movement within said indicator housing;

(c) a conduit secured to a first end of said indicator housing;

(d) a cable encased in said conduit, said cable attached to a rack at one end thereof and to said indicator at a second end thereof;

(e) a spring disposed within said indicator housing for biasing said indicator toward a second end of said indicator housing; and (f) an indicating bracket attached to said indicator housing adjacent said second end thereof, said indicating bracket having a slot of a predetermined width and a cavity disposed opposite said indicator, said slot for viewing said indicator upon said hand brake mechanism being in said fully applied position, said cavity for viewing said indicator upon said hand brake mechanism being in said fully released position.

16. A hand brake mechanism as set forth in claim 15, wherein said indicator includes a coating, said coating visually distinguishing said indicator from said one of said pair of bogie side frames.

17. A hand brake mechanism as set forth in claim 16, wherein said coating is a reflective tape.

18. A hand brake mechanism as set forth in claim 15, wherein said at least one visual indicating means is a pair of visual indicating means each disposed at a respective one of said pair of bogie side frames.

19. A hand brake mechanism, as set forth in claim 1, further comprising an electronic sensor including a sensing means disposed in a predetermined position near said second side of said housing for detecting an end of a rack disposed adjacent said second side of said housing upon said hand brake mechanism being in a fully released position, said sensing means having an electrical connection for providing at least one signal to a railway vehicle control system for notifying a train operator of said hand brake mechanism being in said fully released position.

20. A hand brake mechanism, as set forth in claim 19, wherein said electronic sensor further includes an activation means attached to said rack.

21. In a truck mounted brake assembly including a brake actuator, a slack adjuster, a pair of transfer levers and a pair of brake beams mounted at each end of such truck mounted brake assembly, each of such brake beams having a brake head attachable to each end thereof, each of such brake heads carrying a brake shoe thereon, each of such brake heads being positioned for engagement of a respective one of such brake shoes with a respective wheel of a wheel and axle set of said railway vehicle during a brake application, each of said brake beams being vertically suspended with a suspension system having a first means pivotally connected at a first end thereof with a predetermined portion of one of a pair of truck side frames and a truck bolster member and pivotally connected at a second end thereof to a predetermined portion of such truck mounted brake assembly for vertically suspending said pair of brake beams in a railway vehicle truck arrangement, said suspension system further having a second means having at least a portion thereof connected with said truck mounted brake assembly for maintaining each of said brake beams in a predetermined plane during application and release of said railway vehicle brake assembly, the improvement comprising:

(a) each of said brake beams including a pair of side members, a top member, and a bottom member, said top and said bottom members join respective ends of said side members to form an aperture within each of said brake beams;

(b) a pair of strut members having a pivot extending outwardly from each of said brake beams, each of said strut members securable with said top and bottom members of each of said brake beams; and (c) a hand brake mechanism securable to one of said pair of brake beams, said hand brake mechanism including:

(i) a housing including a front wall, a rear wall, a first side having an aperture, a second side disposed opposite said first side, and at least one mounting member;

(ii) a manually operable driving means disposed within said housing, said manually operable driving means having a drive shaft connectable with at least one drive wheel mounted to one of said pair of said truck side frames, a drive pinion secured to said first drive shaft for rotation therewith, at least one transfer gear rotatably secured within said housing, said at least one transfer gear meshing with said drive pinion, at least one transfer pinion coupled to said at least one transfer gear for rotation therewith, and a rack adapted for reciprocal linear motion within said housing, said rack having a top surface for meshing with said at least one transfer pinion, said rack for transferring a force applied by said at least one drive wheel to one of said pair of transfer levers connected to said brake actuator for effecting said brake application, said rack extending through an aperture of said housing during said brake application; and (iii) a clutch mechanism cooperatively connected with said manually operable driving mechanism and operable upon rotation thereof in one direction and upon buildup of force in thereof for effecting said brake application, to an engaged disposition in which said driving means is constrained from rotation in said opposite direction and thereby maintaining said brake application until released, said clutch mechanism having a ratchet wheel rotatable along with said manually operable driving means and cooperative with a spring biased holding pawl, upon termination of manual effort on said manually operable driving means for retaining thereof and said brake application in a state of equilibrium, said clutch mechanism further including a clutch collar rotatably engaged with a splined nut coupled to said threaded portion of said first drive shaft, an annular stationary cam member secured in fixed coaxial surrounding relation to said drive shaft adjacent to the end to which said drive pinion is secured, an annular movable cam disposed coaxially with and in surrounding relation to said stationary cam and being connected therewith by complementary fast pitch threads formed partly on said stationary cam and partly on said movable cam.

22. The improvement according to claim 21, wherein said hand brake mechanism is disposed within spatial confines of said truck arrangement of said railway vehicle.

23. The improvement according to claim 21, wherein said each of said pair of brake beams disposed symmetrical with a horizontal plane force path as related to a longitudinal centerline of said wheel and axle set for optimized brake shoe to wheel interface.

24. The improvement according to claim 21, wherein said predetermined portion of one of said pair of truck side frames and said truck bolster member includes at least one hanger bracket rigidly attached to said bolster and having a pivotal connection.

25. The improvement according to claim 21, wherein said at least one hanger bracket is a plurality of hanger brackets rigidly attached to said bolster for pivotally coupling to each of said first end of said first means and said first end of said second means.

26. In a car mounted brake assembly including a brake actuator, a slack adjuster and a pair of brake beams mounted at each end of such car mounted brake assembly, such brake beams being actuated by such brake actuator via a series of levers and linkages, each of such brake beams having a brake head attachable to each end thereof, each of such brake heads carrying a brake shoe thereon, each of such brake heads being positioned for engagement of a respective one of such brake shoes with a respective railway vehicle wheel during a brake application, the improvement comprising a car mounted hand brake mechanism including:

(a) a housing including a front wall, a rear wall, a first side having an aperture, a second side disposed opposite said first side, and at least one mounting member;

(b) a manually operable driving means disposed within said housing, said manually operable driving means having a drive shaft connectable with at least one drive wheel mounted to one of said pair of said truck side frames, a drive pinion secured to said drive shaft for rotation therewith, at least one transfer gear rotatably secured within said housing and meshing with said drive pinion, at least one transfer pinion coupled to said at least one transfer gear for rotation therewith, and a rack adapted for reciprocal linear motion within said housing, said rack having a top surface for meshing with said at least one transfer pinion, said rack f or transferring a force applied by said at least one drive wheel to one of a pair of transfer levers connected to said brake actuator for effecting said brake application, said rack extending through an aperture of said housing during said brake application; and (c) a clutch mechanism cooperatively connected with said manually operable driving mechanism and operable upon rotation thereof in one direction and upon buildup of force in thereof for effecting said brake application, to an engaged disposition in which said driving means is constrained from rotation in said opposite direction and thereby maintaining said brake application until released, said clutch mechanism having a ratchet wheel rotatable along with said manually operable driving means and cooperative with a spring biased holding pawl, upon termination of manual effort on said manually operable driving means for retaining thereof and said brake application in a state of equilibrium, said clutch mechanism further including a clutch collar rotatably engaged with a splined nut coupled to said threaded portion of said first drive shaft, an annular stationary cam member secured in fixed coaxial surrounding relation to said drive shaft adjacent to the end to which said drive pinion is secured, an annular movable cam disposed coaxially with and in surrounding relation to said stationary cam and being connected therewith by a complementary fast pitch threads formed partly on said stationary cam and partly on said movable cam.

27. The improvement according to claim 26, wherein each of said brake beams being suspended with a suspension system having a first means pivotally connected at a first end thereof with a predetermined portion of one of a pair of truck side frames and a truck bolster member and pivotally connected at a second end thereof to a predetermined portion of such truck mounted brake assembly for suspending said pair of brake beams in such railway vehicle truck arrangement, said suspension system further having a second means having at least a portion thereof connected with said truck mounted brake assembly for maintaining each of said brake beams in a predetermined plane during application and release of said railway vehicle brake assembly.

* * * * *